US005429088A

United States Patent [19]

Lang et al.

[11] Patent Number: 5,429,088

[45] Date of Patent: Jul. 4, 1995

[54] METHOD AND ARRANGEMENT FOR CONTROLLING A POSITIONING DEVICE IN A MOTOR VEHICLE

[75] Inventors: Eberhard Lang, Erligheim; Bernd Zimmermann, Vaihingen/Enz, both of Germany

[73] Assignee: Robert Bosch GmbH, Stuttgart, Germany

[21] Appl. No.: 77,771

[22] Filed: Jun. 18, 1993

[30] Foreign Application Priority Data

Jul. 2, 1992 [DE] Germany ..... 42 21 768.7

[51] Int. Cl.[6] ..... F02M 3/00

[52] U.S. Cl. ..... 123/339.14

[58] Field of Search ..... 123/339

[56] References Cited

U.S. PATENT DOCUMENTS

| | | | |
|---|---|---|---|
| 5,031,595 | 7/1991 | Heck et al. | 123/339 |
| 5,046,467 | 9/1991 | Arnold et al. | 123/339 |
| 5,140,960 | 8/1992 | Fujimoto et al. | 123/339 |
| 5,161,508 | 11/1992 | Zentgraf et al. | 123/400 |
| 5,245,966 | 9/1993 | Zhang et al. | 123/339 |
| 5,251,599 | 10/1993 | Ohuchi et al. | 123/339 |
| 5,265,570 | 11/1993 | Schnaibel et al. | 123/339 |
| 5,265,571 | 11/1993 | Sodeno | 123/339 |
| 5,293,852 | 3/1994 | Lehner et al. | 123/339 |

*Primary Examiner*—Raymond A. Nelli
*Attorney, Agent, or Firm*—Walter Ottesen

[57] ABSTRACT

The invention is directed to a method and an arrangement for controlling a positioning device. The positioning device is positioned on the basis of a drive time without position feedback. A base displacement time is provided which is corrected by comparing a desired value to an actual value at pregiven time points.

10 Claims, 3 Drawing Sheets

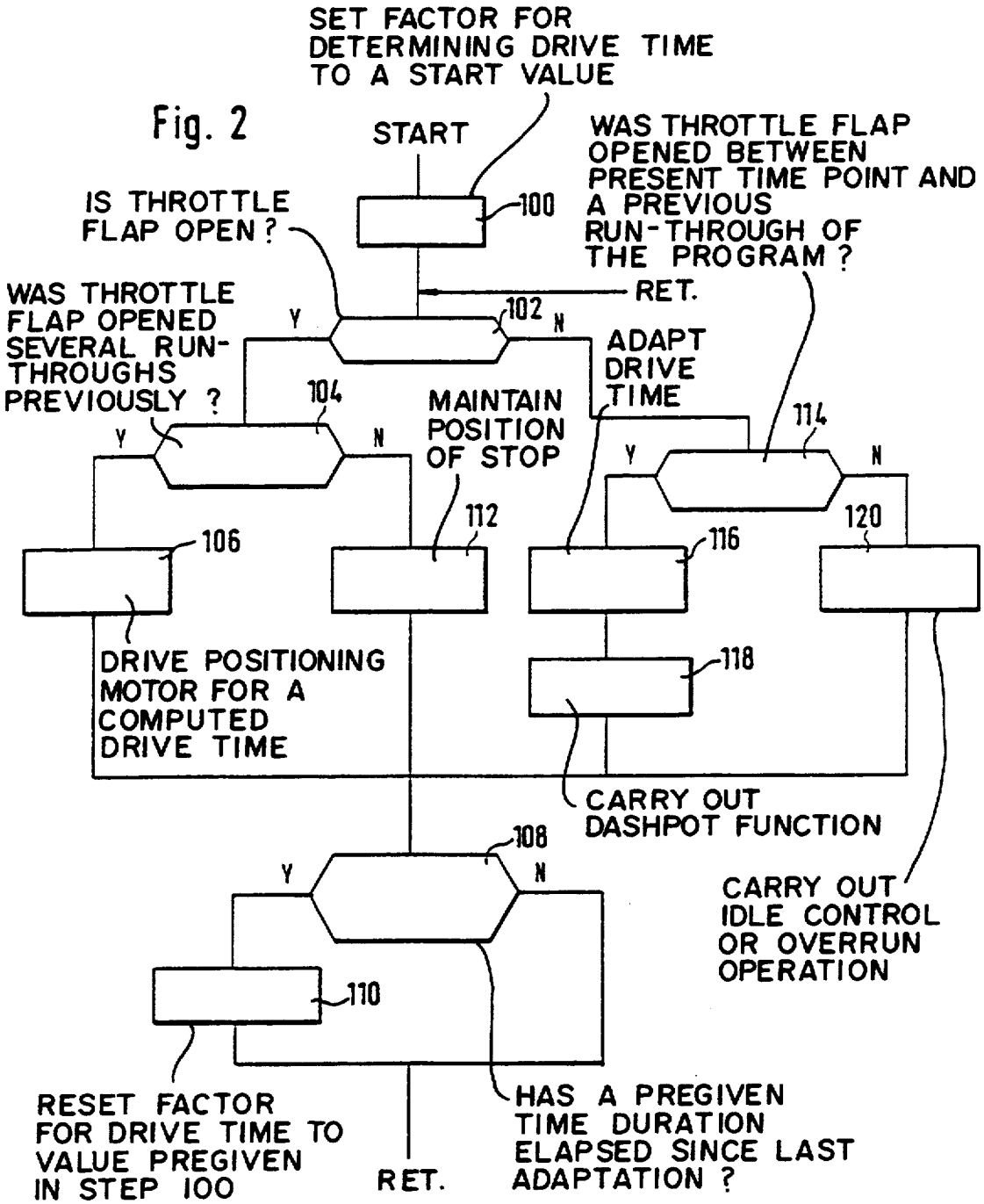
Fig. 2
START
SET FACTOR FOR DETERMINING DRIVE TIME TO A START VALUE
100
IS THROTTLE FLAP OPEN ?
WAS THROTTLE FLAP OPENED BETWEEN PRESENT TIME POINT AND A PREVIOUS RUN-THROUGH OF THE PROGRAM ?
RET.
102
Y
N
WAS THROTTLE FLAP OPENED SEVERAL RUN-THROUGHS PREVIOUSLY ?
104
ADAPT DRIVE TIME
MAINTAIN POSITION OF STOP
114
106
112
116
120
DRIVE POSITIONING MOTOR FOR A COMPUTED DRIVE TIME
118
CARRY OUT DASHPOT FUNCTION
108
CARRY OUT IDLE CONTROL OR OVERRUN OPERATION
110
RESET FACTOR FOR DRIVE TIME TO VALUE PREGIVEN IN STEP 100
RET.
HAS A PREGIVEN TIME DURATION ELAPSED SINCE LAST ADAPTATION ?

METHOD AND ARRANGEMENT FOR CONTROLLING A POSITIONING DEVICE IN A MOTOR VEHICLE

FIELD OF THE INVENTION

The invention relates to a method and an arrangement for controlling a positioning device in a motor vehicle. The positioning device includes at least one electrically-actuable positioning element and a control unit for generating a drive signal for actuating the positioning device.

BACKGROUND OF THE INVENTION

A method and arrangement of this kind are disclosed, for example, in U.S. Pat. Nos. 5,031,595 and 5,046,467.

U.S. Pat. No. 5,046,467 discloses a control system for adjusting the throttle flap in idle for idle control. For this purpose, a positioning device is provided which actuates a contact when the throttle flap comes into contact engagement with a movable stop whereafter the idle control is activated. In normal driving operation, and when the throttle flap is lifted away from this stop by actuating the accelerator pedal, the stop is moved to a predetermined position which lies above the throttle flap angle necessary for idle control. The stop is moved to the position necessary to idle control in accordance with a pregiven time function when the throttle flap comes into contact engagement with this stop. This so-called dashpot function improves the exhaust gas performance and the driving performance when the accelerator pedal is suddenly released and effectively prevents undershoots in the speed of the engine.

The above arrangement is problematic in that no position feedback with respect to the stop is provided during driving operation. For this reason, the danger is present that the stop is moved too little or too far in the open direction of the throttle flap during driving operation so that an unwanted high idle engine speed can occur when the throttle flap is in contact engagement with the stop or an engine speed which is too low can occur which can cause the engine to stall.

Problems of this kind are present in those control systems for positioning devices wherein no position feedback of the positioning element is provided. This is also, for example, the case for simple drive slip-control systems without position feedback of the throttle flap for which the actuation of the throttle flap in the direction of the closed position leads to a reduction of the slip and leads to a stalling of the engine in an unfavorable situation.

SUMMARY OF THE INVENTION

In view of the above, it is an object of the invention to ensure a satisfactory control of the positioning element into a specific position without position feedback.

According to a feature of the invention, the control of the positioning device takes place during a displacement time with a base displacement time for reaching a desired position being assumed. Also, a desired value is compared to that value actually reached when the positioning device is driven for this base displacement time and the base displacement time is corrected in accordance with this comparison.

U.S. Pat. No. 5,031,595 discloses a positioning device for a throttle flap for idle-speed control wherein different safety measures are undertaken for checking the operation of the positioning device.

The procedure according to the invention ensures the adjustment of a pregiven position of a positioning device without position feedback. This adjustment of position is then independent of deterioration or drift.

A dashpot function can be realized by the procedure according to the invention without unwanted driving situations occurring in the case of a fault if the positioning device is applied in connection with the adjustment of a throttle flap of an internal combustion engine for idle control.

By applying the procedure according to the invention it is especially advantageous that existing monitoring measures can be continued without changes and the operability of the arrangement is accordingly guaranteed.

Furthermore, it is advantageous that a fault function of the control method does not bring about unwanted driving conditions with the control method being based on the procedure according to the invention.

According to another feature of the invention, the measures provided by the invention for detecting a fault in the area of the positioning device are evaluated.

BRIEF DESCRIPTION OF THE DRAWINGS

The invention will now be described with reference to the drawings wherein:

FIG. 2 is a flowchart showing the method of the invention; and,

DESCRIPTION OF THE PREFERRED EMBODIMENTS OF THE INVENTION

Figure 1:
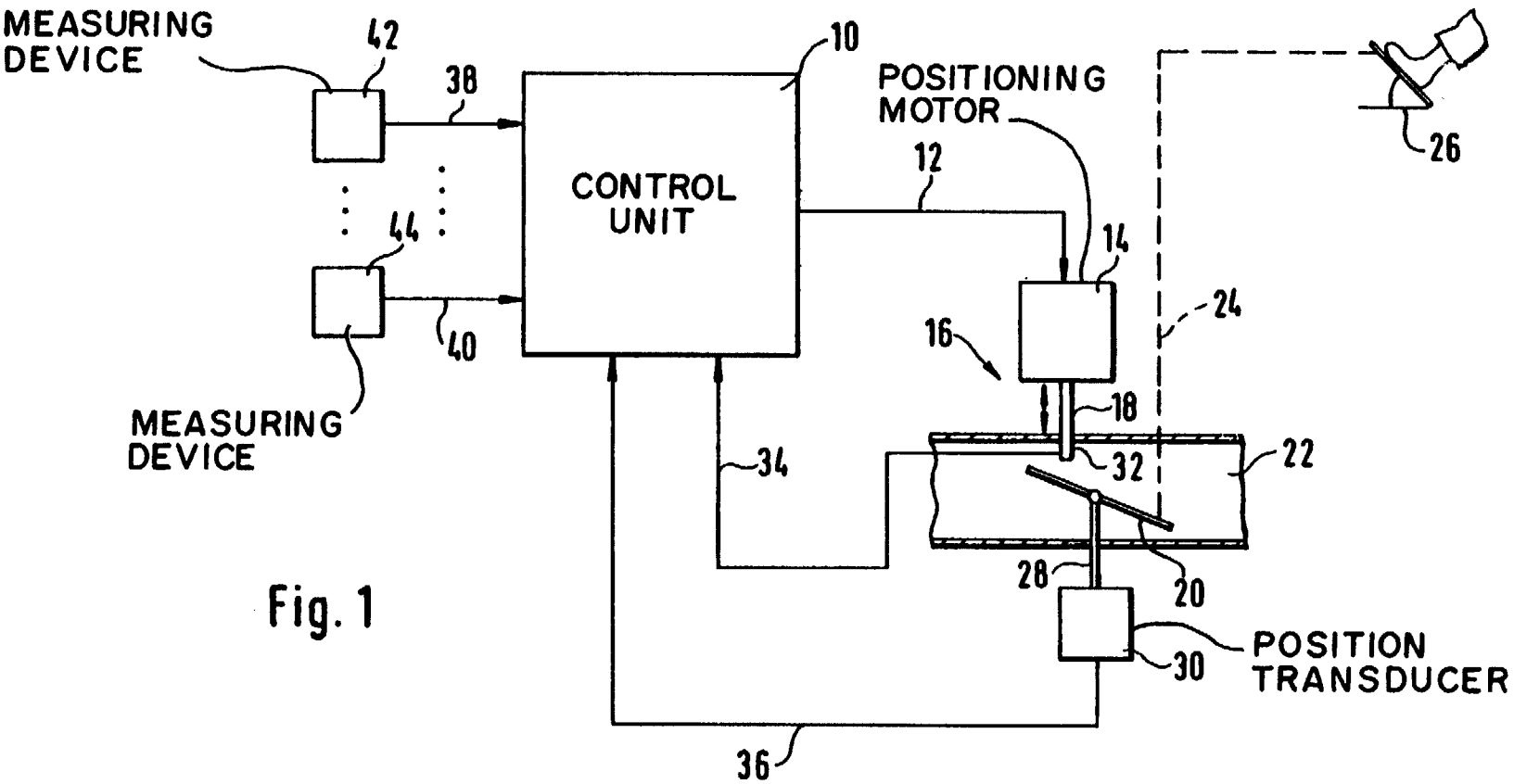
FIG. 1 is a block circuit diagram of a preferred embodiment of a motor control system applying the procedure according to the invention.

FIG. 1 provides an overview schematic of a preferred engine-control system wherein the procedure provided by the invention is applied. It is here emphasized that the procedure according to the invention can also be used in connection with other control arrangements for positioning devices wherein the adjustment of a positioning device is effected to a pregiven position without feedback.

In FIG. 1, reference numeral 10 identifies a control unit which has an output line 12 which, in turn, is connected to a positioning motor 14 of a positioning device 16. In addition to the positioning motor 14, the positioning device 16 includes a movable stop 18 which is actuated by means of the positioning motor 14.

FIG. 1 also shows a throttle flap 20 in the intake pipe 22 of an internal combustion engine. The throttle flap 20 is connected to an operator-actuated element 26 by means of a mechanical or electrical connection 24. The operator-actuated element can, for example, be an accelerator pedal. The throttle flap 20 is connected to a position transducer 30 via a mechanical connection 28. The position transducer 30 detects the position of the throttle flap 20.

The positioning device 16 also includes a switching element 32 which is so configured that it changes its switching state when the throttle flap 20 comes into contact engagement with the movable stop 18. One such arrangement is disclosed, for example, in U.S. Pat. No. 5,031,595 incorporated herein by reference.

The control unit 10 has the input lines described below. A line 34 connects the control unit 10 to the switching element 32 of the positioning device 16 and a line 36 connects the control unit 10 to the position transducer 30. Input lines 38 to 40 connect the control unit 10 to measuring devices 42 to 44, respectively, for measuring additional operating variables of the engine and/or of the motor vehicle.

The control unit 10 includes the output line 12 for actuating the positioning motor 14. In addition to this line, the control unit 10 includes output lines (not shown) which are provided for adjusting the fuel metering and/or the ignition angle. In other embodiments, output lines can be provided also for controlling an automatic transmission if required.

The control unit 10 forms a desired value in idle for the positioning of the movable stop 18 in dependence upon the operating variables supplied via the input lines 38 to 40 from the measuring devices 42 to 44, respectively. The adjustment of the throttle flap 20 takes place by means of the movable stop 18 and thereby influences the engine speed and can control this engine speed to a pregiven value. Engine speed, engine temperature, battery voltage, road speed, transmission position, status of the climate control and the like are all operating variables which can be provided in an advantageous manner. This desired value is placed into relationship with the position value of the throttle flap supplied by the position transducer 30 via the line 36. This position value corresponds to the position of the stop 18 in idle. The control unit 10 then generates an output signal for actuating the positioning motor 14 and for adjusting the stop 18 in the sense of an approximation of the measured position value to the pregiven position value.

This output signal is supplied via the line 12 to the positioning motor 14 so that the actual engine speed approximates the desired engine speed. The described idle control is active in the idle state when the switching element 32 is closed; that is, when the throttle flap 20 is in contact engagement with the movable stop 18. If the operator actuates the operator-actuated element 26, then the throttle flap 20 lifts away from the movable stop 18. The switching element 32 changes its switching state and goes especially into its open state. The described idle control is deactivated since the control unit 10 detects the change of the switching state via the line 34. In accordance with the description provided above, the movable stop 18 is moved into a pregiven position by actuating the positioning motor 14 in the direction of opening the throttle flap 20 for realizing a dashpot function. The above-mentioned position is above the position necessary for idle control. The actuation of the movable stop 18 then takes place in that the positioning motor 14 is driven for a pregiven time duration in the direction "open" so that the pregiven position of the movable stop 18 is adjusted. If the throttle flap in idle is opened beyond the pregiven position, then the drive takes place in the direction "closed" or, in a preferred embodiment, no drive takes place in order to prevent the engine from stalling.

The control of the throttle flap into the pregiven position is undertaken for a pregiven time duration preferably with maximum drive signal values. The time duration is so dimensioned that the pregiven position is reached. In other preferred embodiments, the drive signal variable can assume a fixed pregiven value or be, in accordance with a pregiven relationship, dependent upon operating variables such as engine temperature, road speed or the like.

In addition, it is noted that the pregiven position can likewise be dependent upon operating variables, such as being dependent upon the engine temperature, road speed, battery voltage, throttle-flap angle and the like. The throttle flap is moved against the movable stop 18 when the accelerator pedal 26 is released. In this case, the switching element 32 is closed and the movable stop 18 is moved back in accordance with a pregiven function to the position necessary for idle control.

The position reached can be driven to on the basis of the displacement time duration or drive time duration. This position changes in accordance with the deterioration of the positioning motor, the positioning motor type, temperature conditions and voltage conditions. For this reason, measures are provided by the invention which ensure that a pregiven position is reached independently of these influences.

The operation described above is now explained with respect to the flowchart of FIG. 2.

After start of the subprogram, the factor for determining the drive time is set to a start value in a first step 100. A check is made in the following inquiry step 102 as to whether the switching element 32 is in a switching state which corresponds to an open throttle flap. If this is the case, then a check is made in inquiry step 114 as to whether a switching state change of the switching element 32 has taken place, that is, whether the throttle flap was opened between the instant time point and the last program run-through. If this is the case, then the positioning motor is driven for a computed drive time to realize the dashpot function in accordance with step 106. The drive time is then computed on the basis of the dashpot angle reached, that is, on the basis of the position of the movable stop 18 to be reached and the last detected position of the movable stop during the idle control. A table, a characteristic line or characteristic field is advantageously provided in which the position difference is assigned to a pregiven drive time. The table values, characteristic line values and characteristic field values are selected for the most rapid known positioning motor. The specific drive time then leads to the pregiven desired position for the fastest known motor or positioning device. This affords the advantage that, as a rule, the above-mentioned influences on the displacement only lead to a reduction of the position of the positioning motor with respect to the pregiven position. Unwanted driving conditions which can cause an increase of the engine speed are precluded.

After driving the positioning motor in accordance with step 106, a check is made in the next inquiry step 108 as to whether a pregiven time duration has elapsed since the last adaptation of the drive time as will be described below. If this is the case, then, in accordance with step 110, the factor for the drive time is reset to the value pregiven in step 100. The subprogram is repeated with step 102 after the completion of step 110 or in the case of a "no answer" in step 108.

If the determination is made in inquiry step 104 that the throttle flap was opened several program run-throughs previously, then, in accordance with step 112, the positioning motor is no longer driven and the position assumed by the stop is maintained. In this case, the drive quantity necessary for maintaining the position is emitted for positioning devices having feedback elements. Thereafter, the program continues with step 108.

If the detection is made in step 102 that the throttle flap has not opened (that is, that the switching state of the switching element 32 shows a contact engagement of the throttle flap on the movable stop 18) then a check is made in inquiry step 114 as to whether the contact engagement of the throttle flap on the stop took place between the instantaneous time point and the last program run-through. If, in accordance with this check, it is determined that the throttle flap was just closed, then the adaptation of the drive time described with respect to FIG. 3 takes place in accordance with step 116 and, in the following step 118, the so-called dashpot function is carried out. The movable stop 18, which had been moved out, is then moved back in accordance with a pregiven function to the value required for idle control. The program continues with step 108 after the dashpot function has been carried out in accordance with step 118.

If the detection is made in step 114 that the throttle flap has been closed for some time, then an idle control is carried out in accordance with step 120 or a corresponding overrun control is carried out for the case wherein an overrun operation of the engine takes place. Thereafter, the program continues with step 108 and the subprogram is repeated as required.

Figure 3:
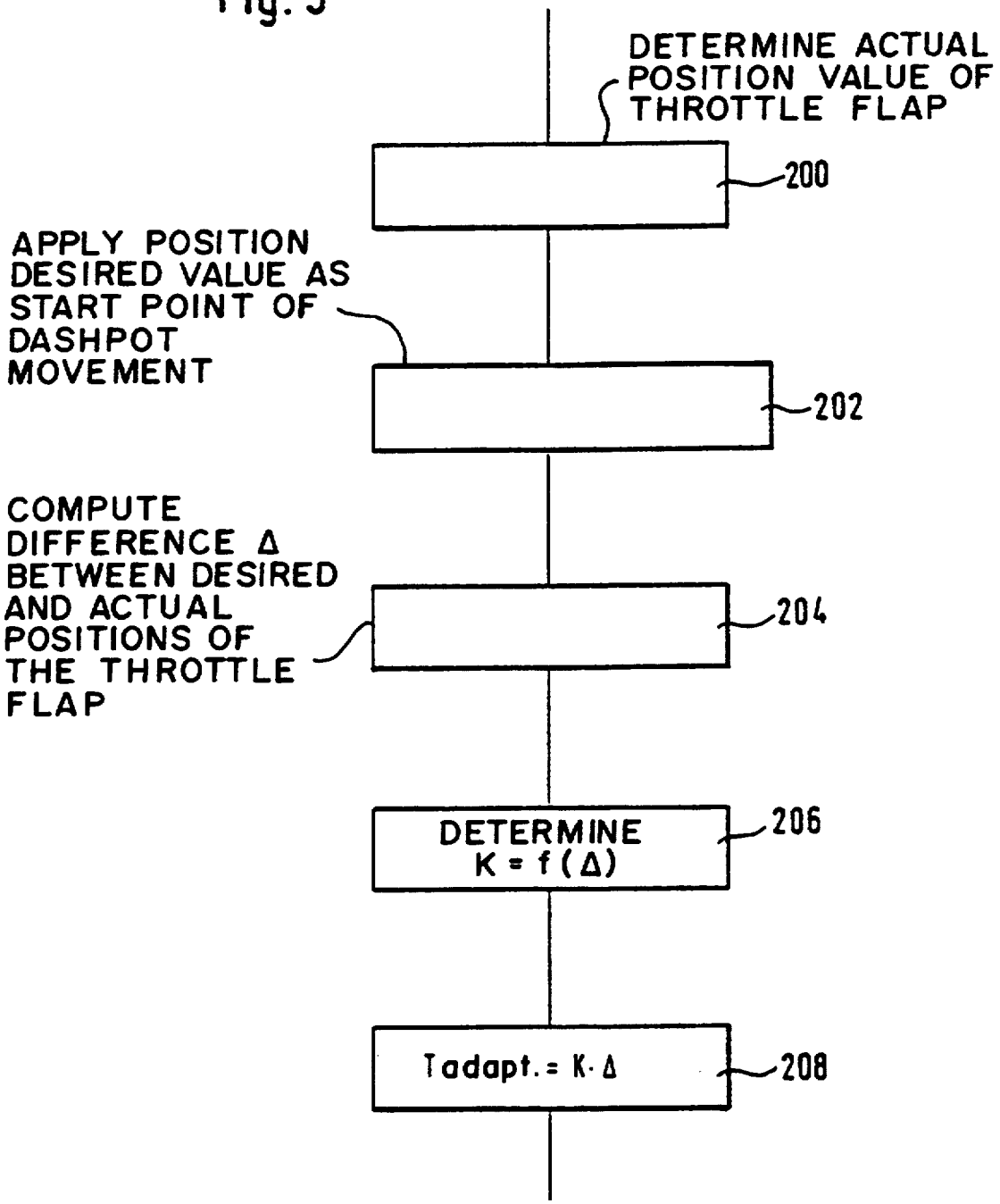
FIG. 3 is a flowchart showing the adaptation of the drive time undertaken in a step of the flowchart shown in FIG. 2.

The so-called adaptation of the drive time carried out in step 116 is described in greater detail with reference to the flowchart of FIG. 3.

In a first step 200, the position value is detected by the position transducer 30 which is present when the throttle flap is in contact engagement with the movable stop and a position value of the throttle flap is determined. In addition, further operating variables are read in. In step 202, the position desired value applied in step 106 for controlling the positioning motor is used as the starting point of the dashpot movement and, in step 204, the difference between the desired value and actual value is computed. This difference ($\Delta$) is utilized in step 206 to determine a proportional constant K by means of a table or characteristic. A corrective value for the base control time is determined in step 108 as the product of the proportionality constant K and the deviation ($\Delta$).

The corrective values for the drive time are computed in step 208 and are used in the next driving state of the arrangement for the determination of the drive time and for driving the positioning motor in accordance with step 106. In general, the parameters are so selected that the corrective control time can be undertaken by means of an addition (in other embodiments other logic operations can be advantageous) of the corrective value to the drive time in step 106 which is determined on the basis of the table or the characteristic fields.

Preferably, the dependency of the proportionality constant of the deviation is so selected that, for a negative deviation, the proportionality constant is greater than for a positive deviation in an advantageous embodiment. This has the result that a greater correction of the drive time is made for negative deviation, that is, for a stop which is driven too far, so that an additional reliability effect is achieved in this way.

The proportionality factor K can be dependent upon the sign of the deviation. However, in an advantageous embodiment, a characteristic line having a proportionality factor which becomes greater is used for an increasing deviation.

An exact drive of the positioning motor can be obtained within a few idle phases in this way. In accordance with the inquiry pursuant to step 108, it is ensured that no new determination of the drive time can take place after a pregiven time duration when there is a possible defective correction and a return to the base value within an operating cycle is ensured.

The procedure described is based on the fact that without position feedback of the positioning motor, the drive of the positioning motor is undertaken on the basis of a displacement time to obtain a pregiven position. The computed pregiven position is set into relationship with the actual position which takes place on the basis of an additional signal associated with the movement of the actuator. The correction of the drive time is determined from the difference between the desired and actual values. Position values must not necessarily be compared to each other; instead, the determination of the deviation can be made from engine-speed values, air throughput values, et cetera. The procedure according to the invention can therefore be used also outside of the described preferred embodiment, for example, for drive slip control systems without feedback or climate controls.

The procedure according to the invention can especially be applied also to positioning devices in connection with diesel engines.

The proportionality constant or the variables representing the change of the positioning time can preferably also be evaluated for fault detection. If the change exceeds a permitted limit, then a conclusion can be drawn as to a fault in the area of the positioning device such as line interruption, short circuits, jamming, increased friction, et cetera.

For positioning devices with feedback elements, the operability of the feedback element can be estimated in this manner or a measure for the intensity of the return torque can be obtained in that the change of the positioning time is evaluated.

In addition, in an advantageous embodiment, it is not a desired value for the position of the throttle flap which is adjusted; instead, a desired value of another operating variable such as engine speed, air throughput, et cetera is adjusted.

It is understood that the foregoing description is that of the preferred embodiments of the invention and that various changes and modifications may be made thereto without departing from the spirit and scope of the invention as defined in the appended claims.

What is claimed is:

1. An arrangement for controlling a positioning device in a motor vehicle, the arrangement comprising:

said positioning device including an element displaceable in position and a drive unit actuable for displacing said element;

a control unit for supplying a drive signal to actuate said drive unit;

said control means including means for supplying a pregiven position for said element;

said control means further including means for applying said drive signal a predetermined time duration (T) based on said pregiven position to actuate said drive unit thereby causing said element to assume an actual position;

means for determining said actual position of said element; and, means for correcting said time duration (T) based on said actual position and said pregiven position.

2. The arrangement of claim 1, said control means including means for forming said time duration (T) from a base displacement time and a corrective quantity; comparator means for comparing a desired value with a value actually obtained when a pregiven operating condition occurs to form a comparison; and, means for determining said corrective quantity in accordance with said comparison.

3. The arrangement of claim 2, further comprising means for adjusting a predetermined value for said position of said element by adjusting said actual position of said element.

4. The arrangement of claim 2, further comprising means for adjusting a desired value of an operating variable by adjusting said actual position of said element.

5. The arrangement of claim 2, further comprising means for providing a corrective quantity and forming said time duration (T) from a base displacement time and said corrective quantity.

6. The arrangement of claim 2, wherein said motor vehicle has an internal combustion engine with an air intake in which a throttle flap is pivotally mounted and said element is a movable stop for said throttle flap; and, wherein said actual position is defined by a contact engagement of said throttle flap and said movable stop.

7. The arrangement of claim 6, further comprising means for driving said drive unit for a determined time duration while said throttle flap is actuated and in such a manner that a position of the throttle flap is detected when coming into contact with said element.

8. The arrangement of claim 3, further comprising means for comparing said predetermined value to said actual value to obtain a comparison and determining said corrective quantity in accordance with said comparison.

9. The arrangement of claim 8, said time duration (T) being a drive time duration and said method further comprising means for evaluating said drive time duration for detecting a fault.

10. The arrangement of claim 9, wherein said base displacement time of said drive time duration corresponds to the fastest known positioning motor for adjusting said predetermined value.

* * * * *